US005809386A

United States Patent [19]

Iwata

[11] Patent Number: 5,809,386

[45] Date of Patent: Sep. 15, 1998

[54] DEVELOPING DEVICE FOR AN IMAGE FORMING APPARATUS

[75] Inventor: Naoki Iwata, Niiza, Japan

[73] Assignee: Ricoh Company, Ltd., Tokyo, Japan

[21] Appl. No.: 773,711

[22] Filed: Dec. 24, 1996

[30] Foreign Application Priority Data

Dec. 25, 1995 [JP] Japan ..... 7-351649
Feb. 17, 1996 [JP] Japan ..... 8-053907

[51] Int. Cl.[6] ..... G03G 15/08

[52] U.S. Cl. ..... 399/281; 399/102; 399/252; 399/284; 399/285

[58] Field of Search ..... 399/222, 252, 399/258, 281, 284, 289, 272, 273, 270, 283, 285, 286, 98, 102, 103; 430/120

[56] References Cited

U.S. PATENT DOCUMENTS

| | | | |
|---|---|---|---|
| 4,083,326 | 4/1978 | Kroll et al. | 399/281 |
| 4,616,919 | 10/1986 | Adley et al. | 399/103 |
| 5,136,335 | 8/1992 | Takeda et al. | 399/286 |
| 5,172,169 | 12/1992 | Takashima et al. | 399/281 |
| 5,220,129 | 6/1993 | Nishio et al. | 399/284 |
| 5,223,668 | 6/1993 | Takaya et al. | 399/283 X |
| 5,239,344 | 8/1993 | Enoki et al. | 399/285 |
| 5,241,357 | 8/1993 | Iwata | 399/231 |
| 5,286,918 | 2/1994 | Iwata et al. | 399/119 |
| 5,311,263 | 5/1994 | Suzuki et al. | 399/276 |
| 5,315,061 | 5/1994 | Suzuki et al. | 399/239 |
| 5,339,141 | 8/1994 | Suzuki et al. | 399/285 |
| 5,404,211 | 4/1995 | Hashimoto et al. | 399/284 X |
| 5,424,814 | 6/1995 | Suzuki et al. | 399/284 |
| 5,451,713 | 9/1995 | Suzuki et al. | 399/285 |
| 5,502,552 | 3/1996 | Iwata et al. | 399/222 |
| 5,541,029 | 7/1996 | Iwata et al. | 430/45 |

FOREIGN PATENT DOCUMENTS

| | | |
|---|---|---|
| 64-26876 (A) | 1/1989 | Japan . |
| 64-49860 (U) | 3/1989 | Japan . |
| 2-232674 | 9/1990 | Japan . |
| 2-242272 (A) | 9/1990 | Japan . |
| 3-17671 (A) | 1/1991 | Japan . |
| 5-333679 | 12/1993 | Japan . |
| 6-110307 | 4/1994 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

In an image forming apparatus, a developing device includes an upper and a lower feed roller intervening between a developing roller and a toner hopper and contacting the developing roller. The upper and lower feed rollers feed toner to the developing roller. The two rollers rotate in opposite directions to each other in order to move the toner existing therebetween from the hopper side to the developing roller side. The device is capable of forming a laminate developer layer of uniform charge and uniform thickness on the developer carrier, and eliminating the need for a seal member between a casing and the developer carrier or simplifying its configuration.

19 Claims, 12 Drawing Sheets

DEVELOPING DEVICE FOR AN IMAGE FORMING APPARATUS

BACKGROUND OF THE INVENTION

The present invention relates to a developing device for a copier, facsimile apparatus, printer or similar image forming apparatus and, more particularly, to a developing apparatus of the type developing a latent image formed on an image carrier by charging to a preselected polarity a single-ingredient type developer with or without an auxiliary agent covering its outer periphery.

For an image forming apparatus of the type forming a latent image on an image carrier and developing it with a developer, a developing device using a single-ingredient type developer is desirable because it is small size, low cost, and reliable. Particularly, a nonmagnetic single-ingredient type developer is advantageously applicable to color image formation due to its inherent clearness. Japanese Patent Laid-Open Publication Nos. 60-229057 and 61-42672, for example, each teaches a developing device using a single-ingredient type developer and including a developer carrier, a developer storing section, and developer feeding means. The developer carrier conveys the developer deposited thereon along a preselected circulation path including a developing position. The developer storing section stores the developer. The developer feeding means feeds the developer stored in the storing section to the developer carrier.

Various schemes for depositing a greater amount of developer for a unit area on the developer carrier have been proposed for the developing device of the type described. Japanese Patent Laid-Open Publication No. 4-127177, for example, discloses a developing device including a developing roller or similar image carrier whose surface consists of minute dielectric portions and conductive portions arranged in a regular or irregular pattern. A developer feeding member rotates in contact with the image carrier while charging a single-ingredient type developer by friction. At the same time, the developer feeding member and developer cooperate to charge the dielectric portions by friction. As a result, a number of minute electric fields referred to as microfields are formed in the vicinity of the surface of the developer carrier. The developer is transferred from the developer feeding member to the developer carrier by the microfields, and deposited on the developer carrier in multiple layers. This microfield scheme stems from the following situation.

In a developing system using, e.g., a nonmagnetic single-ingredient type developer or toner, as referred to hereinafter, the amount of toner deposition on the developer carrier should preferably be such that the toner deposits in an amount of 0.6 mg/cm$^2$ to 1.0 mg/cm$^2$ on an image carrier or in an amount of 0.5 mg/cm$^2$ to 0.7 mg/cm$^2$ on a paper. The amounts of toner deposition on the image carrier and paper depend not only on the amount of deposition on the developer carrier but also on the relative speed between the image carrier and the developer carrier.

The problem with a developing device of the type described and put to practical use is that toner deposits on a developer carrier only in a single layer in an amount of 0.2 mg/cm$^2$ to 0.5 mg/cm$^2$. Therefore, to deposit the toner on, e.g., an image carrier in the above desired amount, the developer carrier must move at a speed twice to four times the speed of the image carrier. Such a high speed, however, makes it difficult to increase the image forming speed and causes, when a solid image is developed, image density to increase at the trailing edge portion of the image. Such partial high image density is not critical with a black-and-white image. However, when it comes to a color image, the image appears dark at its trailing edge portion because a color is perceived through the toner. Particularly, when different colors are laid one upon the other, the trailing edge portion of the image appears different in colors.

To deposit the desired amount of toner on, e.g., the image carrier while obviating the above partial high image density, it is necessary to move the developer carrier at a speed close to the speed of the image carrier, i.e., to implement nearly equispeed development, and to deposit the toner in a greater amount on the developer carrier than conventional. Specifically, to guarantee a sufficient amount of toner on the image carrier or the paper by the nearly equispeed development, the toner must be deposited on the developer carrier in an amount of at least 0.8 mg/cm$^2$ by contact development or in an amount of at least 1.0 mg/cm$^2$ by noncontact development less efficient than the contact development. Such an amount of toner deposition on the developer carrier has not been achievable without resorting to two or more consecutive layers of toner. Moreover, if the toner layer formed on the developer carrier contains non-charged toner and toner charged to the opposite polarity, there occur various troubles including defective toner transfer to the image carrier, background contamination, and low resolution. Therefore, an implementation for charging the entire laminate toner layer, including an upper layer apt to be short of charge, and setting up a stable toner charge distribution has been needed. In addition, a mean toner charge ranging from 5 $\mu$c/g to 10 $\mu$c/g has been desired.

The developing device capable of forming a stably charged laminate toner layer on the image carrier as mentioned earlier is derived from the above situation. The microfields formed on the developer carrier allow the single-ingredient type developer to be transferred from the developer feeding member to the developer carrier and form a laminate layer thereon. This successfully stabilizes the system and enhances image quality.

However, the conventional microfield scheme has some problems left unsolved, as follows. Assume that the developer feeding member and developing roller, or developer carrier, rotate in the same direction, e.g., counterclockwise. Then, it is likely that the developer delivered from the developer storing section to the developer feeding member and expected to be transferred from the feeding member to the developing roller via the nip between them is partly directly transferred to the roller. The developer regulating member regulates the entire developer deposited on the roller, forming a laminate developer layer on the roller. Such a developer layer is apt to be short of charge and be thicker than expected. This is likely to render the development irregular and to cause the developer to fly about. Further, when a great amount of developer is consumed due to the development of a solid image, the consumption cannot be sufficiently made up for by a single feed. That is, a desired layer thickness and a desired amount of charge are not achievable unless the roller passes the nip between it and the member several consecutive times.

Assume that the developer feeding member and developing roller rotate clockwise and counterclockwise, respectively. Then, the developer fed from the developer feeding member toward the developing roller is conveyed to the nip between the member and the roller by way of the bottom of the member. As a result, the developer is uniformly charged before it is deposited on the roller. However, the problem with this configuration is that a seal mechanism is necessary in order to prevent the developer conveyed by the lower portion of the roller from leaking via the gap between the roller and a casing. This, coupled with the fact that a heavy load acts on the seal mechanism, results in a complicated arrangement for intercepting the developer.

It is to be noted that the above problems sometimes arise even in developing devices other than the device using the microfields.

Conventional technologies relating to the present invention are also taught in, e.g., Japanese Patent Laid-Open Publication No. 2-242272, Japanese Utility Model Laid-Open Publication No. 64-49860, and Japanese Patent Laid-Open Publication Nos. 3-17671 and 64-26876.

SUMMARY OF THE INVENTION

It is therefore an object of the present invention to provide a developing device of the type using a single-ingredient type developer and capable of forming a developer layer of uniform charge and uniform thickness on a developer carrier and eliminating the need for a seal member between a casing and the developer carrier or simplifying the configuration of the seal member.

It is another object of the present invention to provide a developing device capable of surely feeding, when a great amount of developer is consumed, the developer by a single feed and thereby surely obviating short toner supply.

In accordance with the present invention, a developing device for developing a latent image formed on an image carrier with a single-ingredient type developer with or without an auxiliary agent covering the outer periphery thereof includes a casing. A developer carrier carries the developer thereon by charging it to a preselected polarity. The developer carrier is rotatable such that the side of the periphery thereof received in the casing moves upward. A developer regulating member regulates the developer deposited on the developer carrier in a layer to a preselected thickness. A first developer feeding member contacts the developer carrier at the side closer to a developer storing section than the developer carrier. The first developer feeding member is rotatable such that its surface portion facing the bottom portion of the casing moves toward the developer storing section. A second developer feeding member is located downstream of the first developer feeding member, but upstream of the developer regulating member, in the direction of conveyance in which the developer carrier conveys the developer, and is rotatable in or out of contact with the developer carrier in the direction opposite to the direction of rotation of the first developer feeding member.

Also, in accordance with the present invention, a developing device of the type described includes a developer carrier for charging the developer to a preselected polarity, and conveying it to a developing position. A developer regulating member regulates the developer being conveyed by the developer carrier in the form of a layer to the developing position to a preselected thickness. A first and a second developer feeding member contact or adjoin the developer carrier at a developer storing section side, and are rotatable to move the developer from the developer storing section side toward the developer carrier via a region where they face each other. A distance at which the first and second developer feeding members are closest to each other in the above region is above a preselected lower limit, but below a preselected upper limit. The lower limit is a minimum distance allowing, even when the developer is locally consumed by development in the lengthwise direction of the developer carrier, the developer to be fed to a space surrounded by the first and second developer feeding members and developer carrier in an amount capable of reducing the localization of the developer in the region to a degree which prevents the developer from being fed to the developer carrier unevenly in the lengthwise direction of the developer carrier. The upper limit is a maximum distance generating a restricting force, against the return of the developer from the above region to the developer storing section, guaranteeing a developer pressure in the above space to a degree which prevents the amount of the developer passing through a position where downstream one of the first and second developer feeding members in the direction of developer conveyance by the developer carrier and the developer carrier contact or adjoin from becoming unstable.

Further, in accordance with the present invention, a developing device of the type described includes a developer carrier for charging the developer to a preselected polarity, and conveying it to a developing position. A developer regulating member regulates the developer being conveyed by the developer carrier in the form of a layer to the developing position to a preselected thickness. A first and a second developer feeding member contactor adjoin the developer carrier at a developer storing section side, and are rotatable to move the developer from the developer storing section side toward the developer carrier via a region where they face each other. A voltage sources produces, between the first and second developer feeding members, a potential difference forming an electric field in such a direction that the developer charged to a desired polarity migrates from upstream one of the first and second developer feeding members in the direction of developer conveyance by the developer carrier toward downstream one of said first and second developer feeding members.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1A:
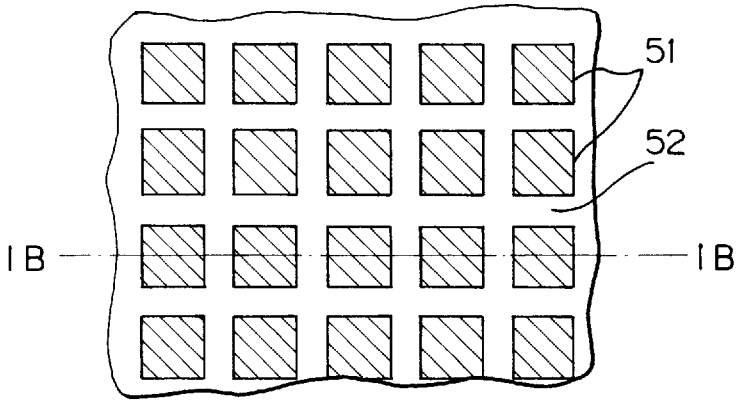
Fig. 1A PRIOR ART
FIGS. 1A and 1B show the configuration and operation of a specific conventional roller.
Figure 1B:
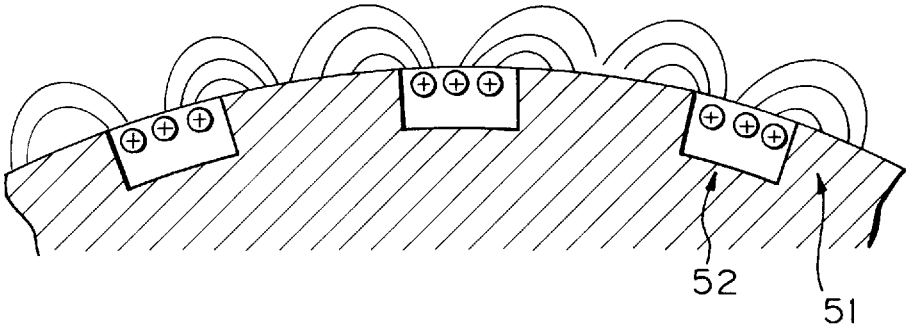
Fig. 1B PRIOR ART

To better understand the present invention, a brief reference will be made to a conventional developing device, shown in FIGS. 1A and 1B. The developing device to be described is of the type taught in, e.g., Japanese Patent Laid-Open Publication No. 4-127177 mentioned earlier. As shown in FIG. 1A, a developing roller included in the developing device has on its surface a plurality of conductive portions 51 and a plurality of dielectric portions 52 arranged in a regular pattern. The conductive portions 51 are connected to ground while the dielectric portions are implemented by a dielectric material. The two kinds of portions 51 and 52 has an extremely small area each. In this configuration, microfields are formed in the vicinity of the surface of the developing roller, as represented by electric lines of force illustrated along a cross-section of FIG. 1A along axis X—X as shown in FIG. 1B. The microfields allow a single-ingredient type developer or toner to be transferred from a developer feeding member to the developing roller and deposition the roller in multiple layers. In this manner, a stably charged laminate toner layer can be formed on the developing layer and can stabilize the system while enhancing image quality.

Figure 2:
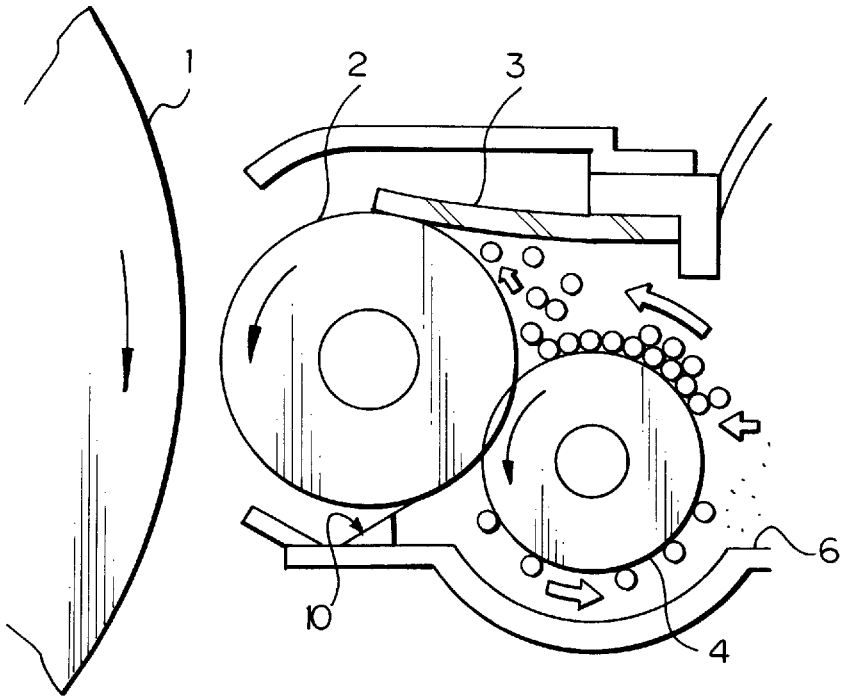
Fig. 2 PRIOR ART
FIGS. 2 and 3 demonstrate the construction and operation of a conventional developing device.

Assume that the developing feeding member and developing roller rotate in the same direction. For example, as shown in FIG. 2, assume that a developing roller 2 and a developer feeding member 4 rotate counterclockwise. Then, the above conventional developing device brings about the problems discussed earlier. That is, it is likely that the developer expected to be transferred from the member 4 to the roller 2 via the nip between them is partly directly transferred to the roller 2. A developer regulating member 3 regulates the entire developer deposited on the roller 2, forming a toner layer on the roller 2. Such a developer layer is apt to be short of charge and be thicker than expected. This is likely to render the development irregular and to cause the developer to fly about. Further, when a great amount of developer is consumed due to the development of a solid image, the consumption cannot be sufficiently made up for by a single feed. That is, a desired layer thickness and a desired amount of charge are not achievable unless the roller 2 passes the nip between it and the member 4 several times. There are also shown in FIG. 2, a photoconductive drum or image carrier 1, a casing 6, and a seal mechanism 10.

Figure 3:
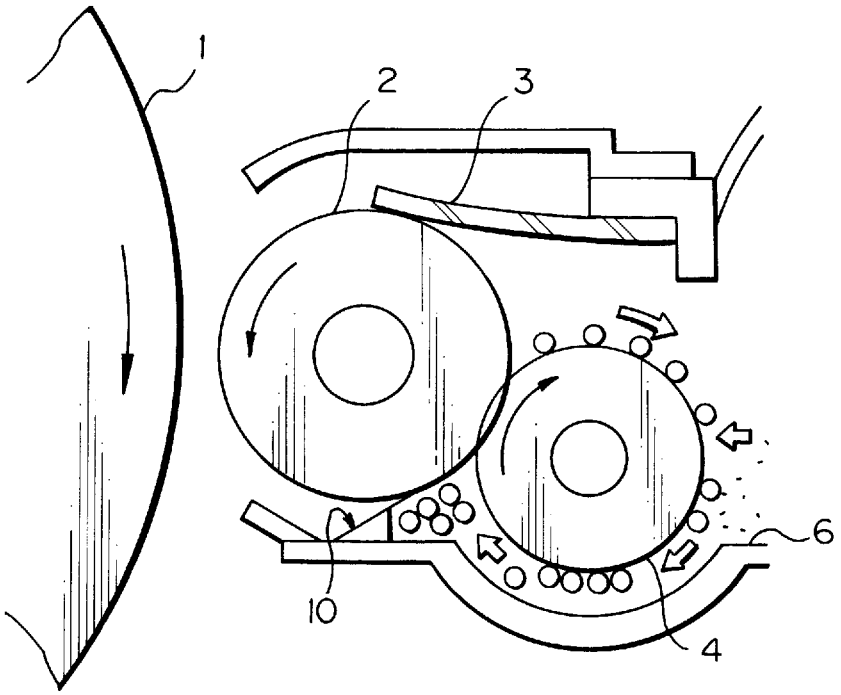
Fig. 3 PRIOR ART

As shown in FIG. 3, assume that the developer feeding member 4 and developing roller 2 rotate clockwise and counterclockwise, respectively. Then, the developer fed from the member 4 toward the roller 2 is conveyed to the nip between the member 4 and the roller 2 by way of the bottom of the member 4. As a result, the developer is uniformly charged before it is deposited on the roller 2. However, the problem with this configuration is that the seal mechanism 10 is necessary in order to prevent the developer conveyed by the lower portion of the roller 2 from leaking via the gap between the roller 2 and the casing 6. This, coupled with the fact that a heavy load acts on the seal mechanism 10, results in a complicated arrangement for intercepting the developer.

Preferred embodiments of the developing device in accordance with the present invention will be described hereinafter. The illustrative embodiments are each applied to an electrophotographic copier by way of example.

1st Embodiment

Figure 4:
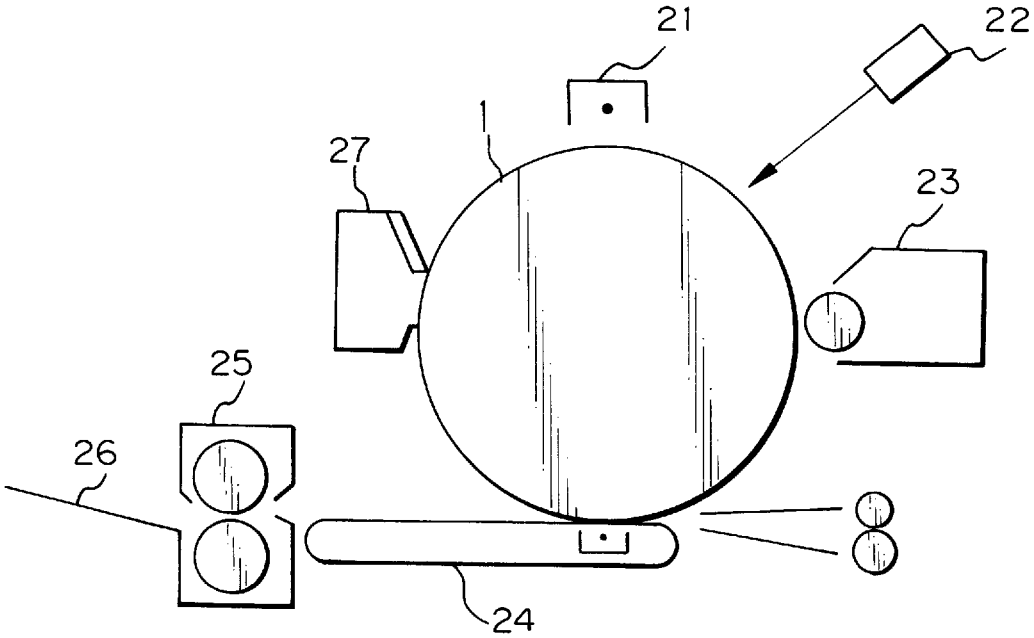
FIG. 4 shows an image forming apparatus to which the present invention is applicable.

Referring to FIG. 4, the general construction of a copier including a developing device 23 embodying the present invention is shown. As shown, the copier has a photoconductive elementor image carrier 1. A main charger 21 charges the surface of the drum 1 uniformly. An exposing device 22 exposes the charged surface of the drum 1 in order to form an electrostatic latent image thereon. The developing device 23 develops the latent image with toner and thereby forms a toner image. An image transfer and transport member 24 transfers the toner image from the drum 1 to a paper or similar recording medium. A fixing device 25 fixes the toner image on the sheet with heat or pressure. The paper with the fixed toner image is driven out of the copier to a tray 26. A cleaning device 27 removes the toner remaining on the drum 1 after the image transfer, thereby preparing the drum 1 for the next image formation.

Figure 5:
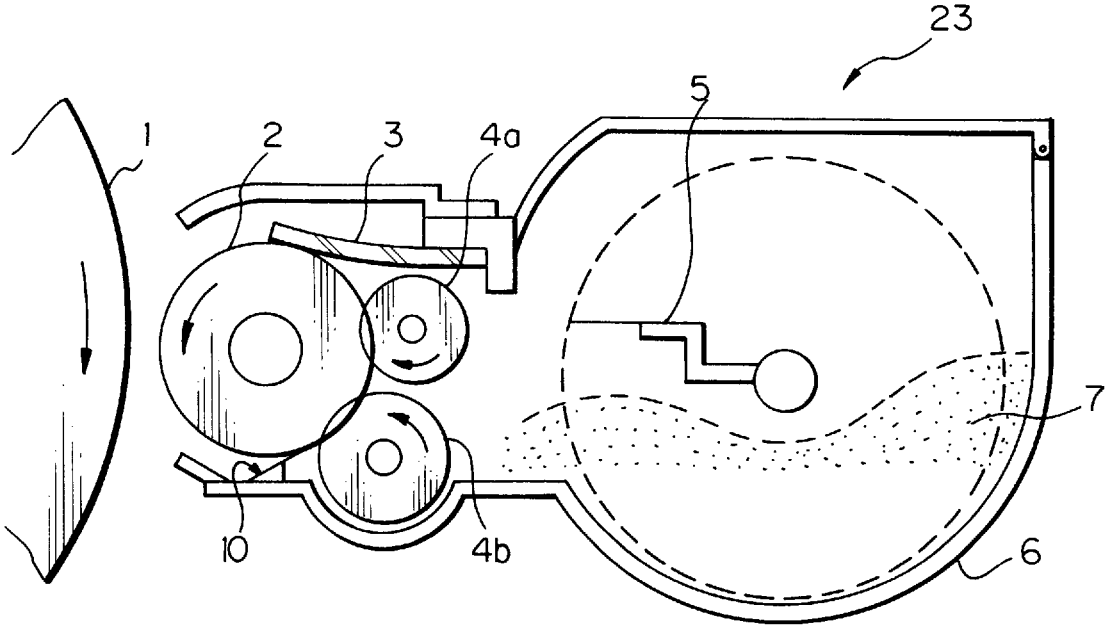
FIG. 5 is a section showing a first embodiment of the developing device in accordance with the present invention.

FIG. 5 shows the developing device 23 in detail. As shown, the developing device 23 includes a toner hopper or toner storing section 6. A developing roller or developer carrier 2 is rotatable in the direction indicated by an arrow at a rate of about 220 mm/sec. The roller 2 also has conductive portions 51 and dielectric portions 52 (see FIG. 7B) regularly arranged on its surface. The conductive portions 51 are connected ground while the dielectric portions 52 are formed of a dielectric material. Microfields are formed between the dielectric portions 52 and the conductive portions 51 on which charge opposite in polarity to the toner is deposited.

A lower feed roller or first developer feeding member 4*b* is formed of foam polyurethane rubber. The roller 4*b* is parallel to and held in contact with the developing roller 2. The roller 4*b* intervenes between the roller 2 and the hopper 6 at a level lower than the level where the roller 2 is rotatably supported. The roller 4*b* bites about 1 mm into the roller 2 at the nip between it and the roller 2. The surface of the roller 4*b* contacting the surface of the roller 2 moves in opposite direction to the surface of the roller 2 at a speed about 0.8 times the rotation speed of the roller 2.

An upper feed roller or second developer feeding member 4*a* is also formed of foam polyurethane rubber. The roller 4*a* is also parallel to and held in contact with the developing roller 2. The roller 4*a* intervenes between the roller 2 and the hopper 6 at a level higher than the level where the roller 2 is rotatably supported. The roller 4*a* bites about 0.8 mm into the roller 2 at the nip between it and the roller 2. The surface of the roller 4*a* contacting the surface of the roller 2 moves in the same direction as the surface of the roller 2 at a speed about 1.2 times the rotation speed of the roller 2.

An elastic blade or developer regulating member 3 is held in contact with the developing roller 2 in the trailing direction with respect to the direction in which the roller 2 rotates.

Toner 7 stored in the hopper 6 is fed to the developing roller 2 by an agitator 5. Then, as represented by outline dots in FIG. 6, the toner 7 is introduced into the gap between the upper and lower feed rollers 4*a* and 4*b*. The lower roller 4*b* rotating in contact with the roller 2 charges the dielectric portions 52 of the roller 2 and the toner 7 by friction. The charged toner 7 is deposited on the roller 2 in a laminate layer by the microfields formed on the roller 2. While the roller 2 conveys the toner 7 deposited thereon, the blade 3 regulates the toner 7 to a preselected thickness.

Subsequently, the toner is brought to a developing position where the roller 2 faces the drum 1. At the developing position, the toner 7 is transferred from the roller 2 to the drum 1 so as to develop a toner image formed on the drum 1. The lower roller 4*b* scrapes off the toner 7 remaining on the roller 2 after the image transfer, again charges the toner 7 by friction, and then feeds it to the roller 2.

Figure 6:
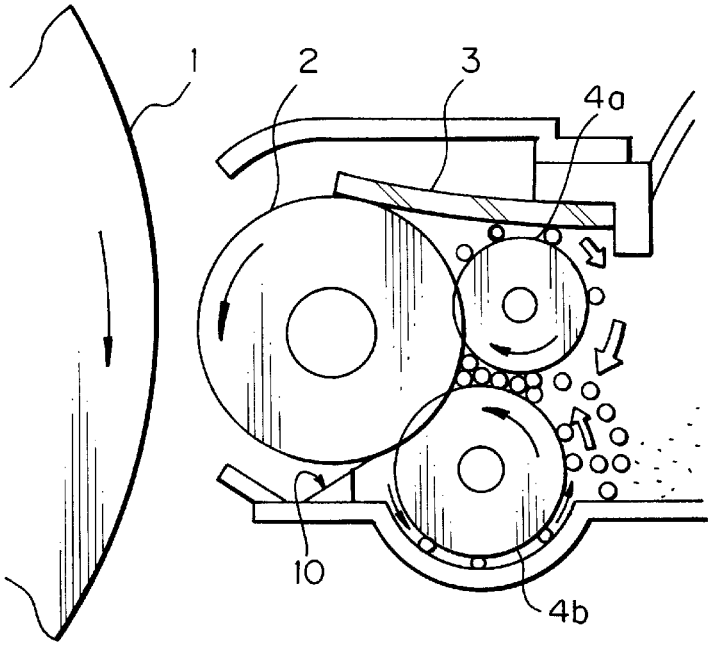
FIG. 6 is an enlarged section showing a developing roller included in the first embodiment and its neighborhood.

It is to be noted that the drum 1 rotates in the direction indicated by an arrow in FIG. 6 at a rate of 200 mm/sec.

It is noteworthy that the toner 7 sequentially fed to the gap between the upper and lower rollers 4*a* and 4*b* by the agitator 5 forms a well at all times. Therefore, even when a solid image is continuously formed a number of times, the toner 7 is continuously fed from the well to the developing roller 2. This prevents the image density from decreasing due to short toner.

The upper feed roller 4*a* in rotation returns the toner 7 tending to get under the blade 3 to the hopper 6, and thereby prevents it from staying below the blade 3. This makes it needless for the blade 3 to be pressed against the developing roller 2 under high pressure. It is therefore possible to maintain the total thickness of the laminate toner layer constant without resorting to a sophisticated mechanism.

The toner 7 below the lower feed roller 4*b* is also returned to the hopper 6 by the roller 4*b*. This successfully prevents the toner 7 from flying out of the developing device 23 without resorting to a seal member 10. While the seal member 10 is shown as being positioned below the developing roller 2, it does not have to be held in close contact with the roller 2, and is therefore simple in configuration.

The illustrative embodiment is practicable with the following specific conditions.

(1) The blade 3 is formed of urethane rubber and provided with a thickness of 2 mm and a length of 11 mm to its free end. The blade 3 bites 0.6 mm into the developing roller 2. The distance between the point of the blade 3 contacting the roller 2 and the free end is 0.5 mm.

Figure 7A:
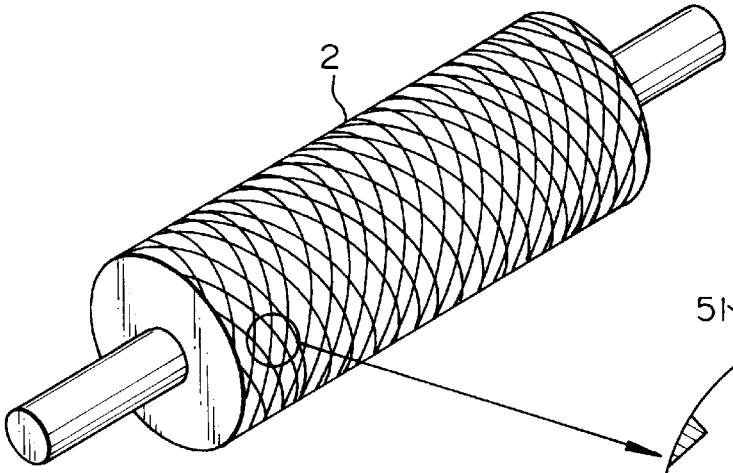
FIGS. 7A and 7B show the configuration of the developing roller of the first embodiment.
Figure 7B:
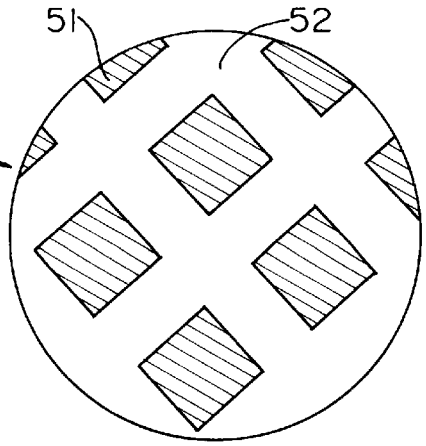

(2) The roller 2 has an aluminum core having a diameter of 20 mm. The surface of the roller 2 is knurled at a pitch of 0.3 mm to form 0.1 mm deep, 0.2 mm wide grooves in a crosshatch pattern. The grooves are inclined 45 degrees. The knurled surface of the core is coated with epoxy modified silicone resin (SR2115 available from Toray) so as to form a dielectric layer. The dielectric layer is dried at 50° C. for about 90 minutes. Finally, as shown in FIGS. 7A and 7B, the surface of the roller 2 is ground until the aluminum surface 51 and dielectric surface 52 appear in a ratio of 3:7.

(3) The upper and lower feed rollers 4*a* and 4*b* are each formed of polyurethane sponge with carbon kneaded therein. The upper roller 4*a* has a diameter of 16 mm and bites 1 mm into the roller 2. The lower roller 4*b* has a diameter of 14 mm and bites 0.8 mm into the roller 2.

(4) The gap between the drum 1 and the roller 2 is 150 $\mu$m. DC −750 V is applied as a bias for development.

(5) The drum 1 is implemented by an organic photoconductor (OPC). The surface potential deposited on the drum 1 is −850 V in the background area or −100 V in an image area.

(6) For the toner 7, use is made of negatively chargeable toner formed of a mixture of nonmagnetic styrene-acryl resin and polyester resin. The toner 7 has a particle size of 10 $\mu$m. 0.7 wt % of fine powder of hydrophobic silica is added to the outer periphery of the toner 7.

The toner 7 forms a well in the space surrounded by the upper and lower feed rollers 4*a* and 4*b* and developing roller 2, as stated earlier. Because the toner 7 arrives at the well continuously, it is necessary to move some of the toner to the downstream side in the direction of toner conveyance and to thereby circulate the toner 7 in the casing of the developing device. For this purpose, the toner 7 should preferably be allowed to move easily via the nip between the upper roller 4*a* and the developing roller 2.

In light of the above, the upper roller 4*a* is formed of a foam material as soft as possible. By contrast, the lower roller 4*b* is formed of a foam material as hard as possible because it should scrape off the toner 7 remaining on the developing roller 2. Specifically, in the configuration shown in FIG. 5, the foam material constituting the upper roller 4*a* should preferably have a density between 35 kg/cm$^3$ and 65 kg/cm$^3$ while the foam material constituting the lower roller 4*a* should preferably have a density between 10 kg/cm$^3$ and 30 kg/cm$^3$.

The upper and lower rollers 4*a* and 4*b* each has a particular foam density, as stated above. The lower roller 4*b* scrapes off the toner 7 remaining on the developing roller 2 after the development, erasing the history of development to a certain degree. Because the toner existing in the well moves via the nip between the upper roller 4*a* and the roller 2, the roller 4*a* is capable of surely feeding a desirable amount of toner to the roller 2 in a single operation. This fully erases the history of development. Therefore, the rollers 4*a* and 4*b* each exhibits the respective function sufficiently.

Moreover, because the toner 7 in the casing of the device is so circulated as to free the blade 3 from excessive loads, the configuration of the blade 3 can be simplified. In addition, even when the seal member 10 is used, its configuration can be simplified because it is free from excessive loads.

Figure 8:
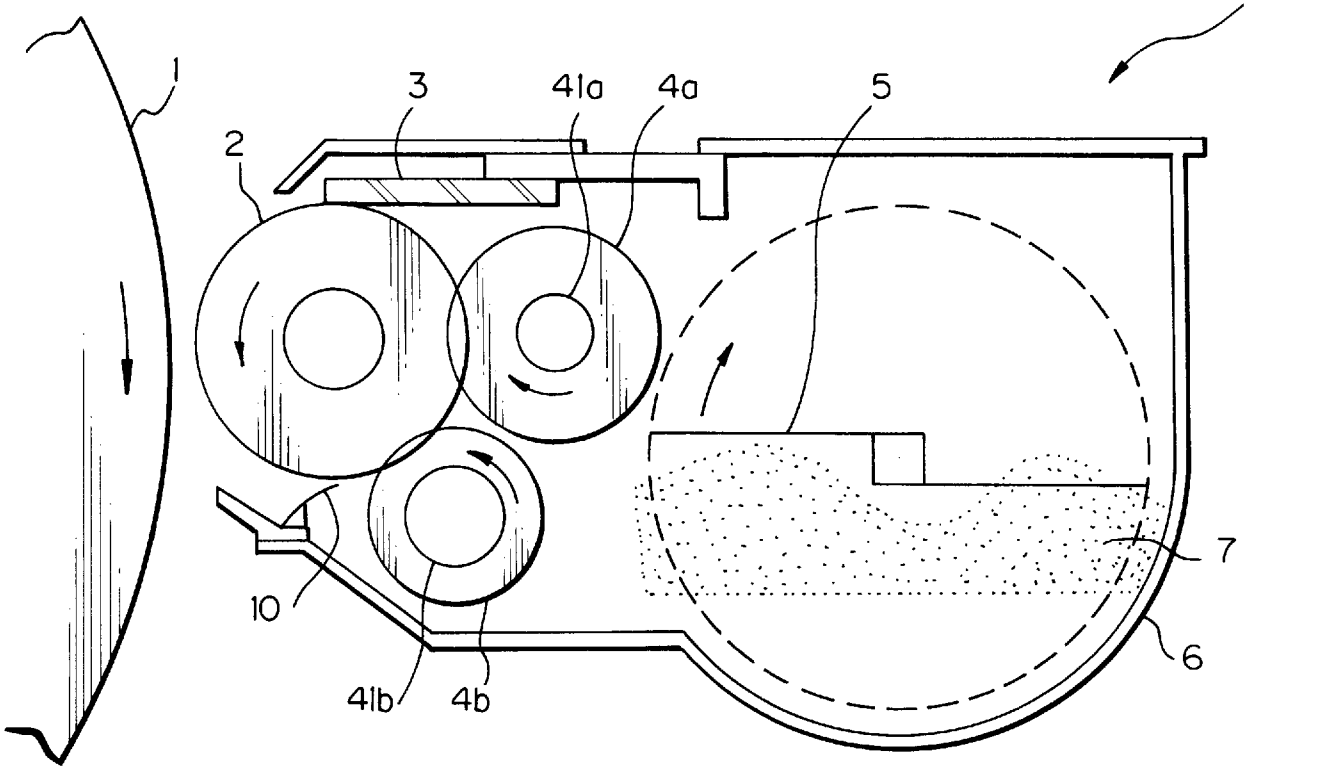
FIG. 8 is a section showing a modification of the first embodiment.

FIG. 8 shows a developing device 23B which is a modification of the illustrative embodiment. The modification is identical with the above embodiment except that the upper and lower rollers 4*a* and 4*b* are each set in a particular condition. Assume that the upper roller 4*a* is caused to bite into the developing roller 2 more than the lower roller 4*b*. Then, the nip between the rollers 2 and 4*b* and the nip between the rollers 2 and 4*a* appear as shown in FIGS. 9A and 9B, respectively.

Figure 9A:
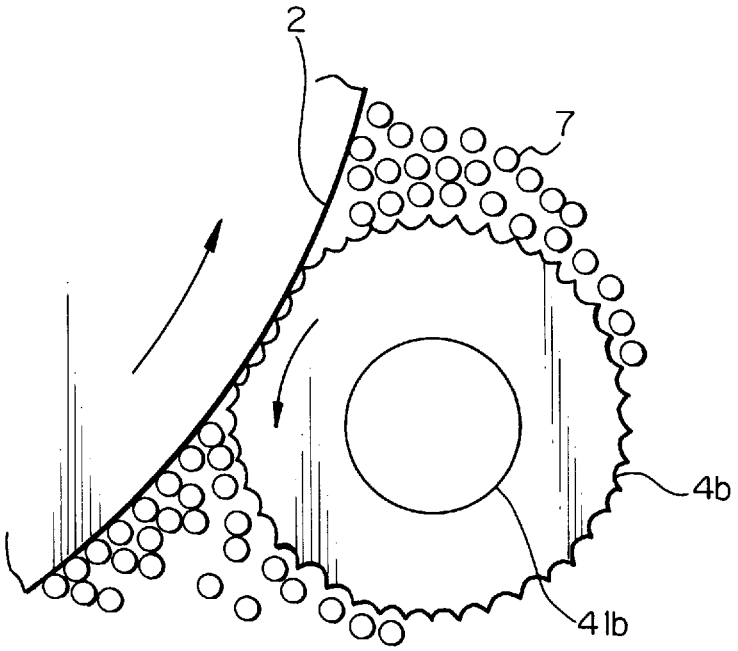
FIG. 9A is an enlarged view showing the developing roller and a lower feed roller also included in the first embodiment.

The lower roller 4*b* shown in FIG. 9A should preferably bite into the developing roller 2 to a certain degree in order to scrape off the toner 7 remaining on the roller 2 after the image transfer. However, if the bite of the roller 4*b* into the roller 2 is excessive, then the drive torque will undesirably increase. It is therefore preferable to select a bite only sufficient for the roller 4*b* to scrape off the toner. When the roller 4*b* is formed of foam polyurethane, as in the embodiment, the roller 4*b* should preferably be so positioned as to bite 0.4 mm to 0.75 mm into the roller 2.

Figure 9B:
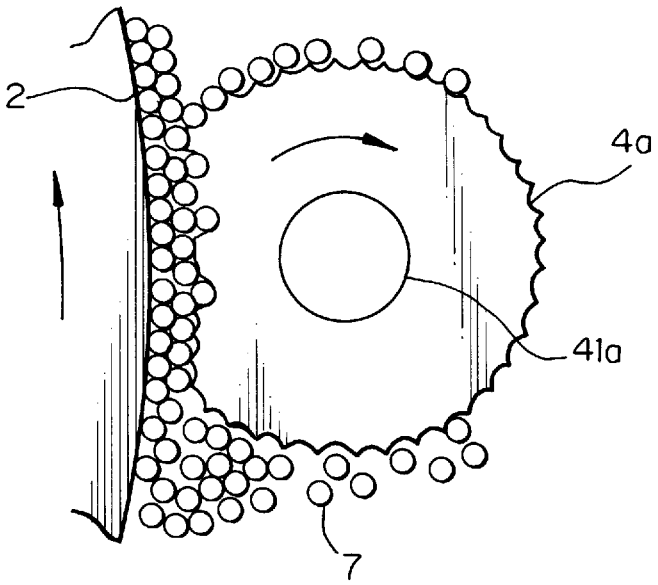
FIG. 9B is an enlarged view showing the developing roller and an upper feed roller also included in the first embodiment.

On the other hand, the upper roller 4*a* shown in FIG. 9B moves in the same direction as the roller 2, as seen at the nip. The roller 4*a* must optimally charge the toner 7 passing through the nip, and must optimally deposit the toner 7 on the roller 2 before the toner 7 reaches the blade 3, FIG. 8. For this reason, the roller 4*a* should preferably bite into the roller 2 more than the roller 4*b*. In the modification, the roller 4*a* should preferably bite 0.8 mm to 1.5 mm into the roller 2.

When only the upper roller 4*a* was used, the drive torque required of the developing device 23 was measured to be between 1.0 kgf/cm to 1.2 kgf/cm. Even when the lower roller 4*b* was used in addition to the upper roller 4*a*, the drive torque was only about 1.5 kgf/cm. Therefore, the increment of the drive torque is only negligible. Further, vibration, for example, ascribable to the contact of the rollers 4*a* and 4*b* with the roller 3 is small enough to insure smooth drive, as determined by experiments.

To allow the rollers 4*a* and 4*b* to exhibit their functions sufficiently, the rollers 4*a* and 4*b* may each be provided with a particular wall thickness. Specifically, the roller 4*b* shown in FIG. 9A does not need a thick wall because the foam material constituting it does not have to be so elastic. Preferably, the roller 4*a* has a wall thickness ranging from 2.0 mm to 3.5 mm. The roller 4*a* shown in FIG. 9B is required to remain in contact with the roller 2 as closely as possible, so that the toner 7 passing through the nip between the roller 4*a* and the roller 2 can obtain desired charge and can form a layer of preselected thickness. That is, the roller 4*a* should have some degree of elasticity. The wall thickness of the roller 4*a* should preferably range from 4 mm to 6 mm.

The lower roller 4*b* moves in opposite direction to the roller 2, as seen at the nip, and scrapes off the toner left on the roller 2 with a noticeable difference in linear velocity. It is therefore likely that the contact between the roller 4*b* and the roller 2 becomes unstable due to the displacement and deformation of a shaft 41*b* on which the roller 4*b* is mounted. By contrast, because the roller 4*a* moves in the direction direction as the roller 2, as seen at the nip, the drive load is comparatively light. Therefore, a shaft 41*a* on which the roller 4*a* is mounted displaces or deforms little. For these reasons, the diameter of the shaft 41*b* of the roller 4*b* and that of the shaft 41*a* of the roller 4*a* are selected to be 7 mm or above and 6 mm or below, respectively.

Assume that the rollers 4*b* and 4*a* each moves at a higher linear velocity than the roller 2. Then, the toner is conveyed to the well surrounded by the rollers 4*b*, 4*a* and 5 in a greater amount, and therefore the amount of toner 7 passing through the nip between the roller 4*a* and roller 4*b* increases. As a result, the toner 7 is fed to the roller 2 in an excessive amount. This is likely to cause the toner 7 of short charge to fly about and to bring about irregular development. Conversely, when the linear velocity of each of the rollers 4*b* and 4*a* is excessively lower than that of the roller 2, the roller 4*a* fails to feed a sufficient amount of toner 7 while the roller 4*b* fails to return the entire toner 7 removed from the roller 2 to the hopper 6. As a result, excessive loads act on the seal member 10.

In light of the above, both the rollers 4*b* and 4*a* should preferably be provided with a maximum ratio in linear velocity to the roller 2 which prevents the toner 7 from depositing on the roller 2 in an excessive amount. As for a minimum ratio, the roller 4*a* should preferably move at a linear velocity allowing it to feed a sufficient amount of toner to the roller 2, while the roller 4*b* should preferably move at a linear velocity allowing it to return the toner 7 removed from the roller 2 to the hopper 6. With this scheme, it is also possible to allow each of the rollers 4*a* and 4*b* to exhibit the respective function sufficiently.

The modification described above is practicable with the following specific conditions. As for the other conditions, the modification is identical with the arrangement shown in FIG. 5.

(1) The upper roller 4*a* is formed of polyurethane sponge with carbon kneaded therein and having a foam density of 25 kg/cm$^3$. The sponge has a thickness of 5 mm. The roller 4*a* has a diameter of 16 mm and mounted on a shaft whose diameter is 6 mm. The roller 4*a* bites 1 mm into the roller 2 and moves in the same direction as the roller 2, but at a linear velocity 0.8 times that of the roller 2.

(2) The lower roller 4*b* is formed of polyurethane sponge with carbon kneaded therein and having a foam density of 40 kg/cm$^3$. The sponge has a thickness of 2.5 mm. The roller 4*a* has a diameter of 13 mm and mounted on a shaft whose diameter is 8 mm. The roller 4*a* bites 0.5 mm into the roller 2 and moves in opposite direction to the roller 2 at a linear velocity 0.5 times that of the roller 2.

2nd Embodiment

Figure 10:
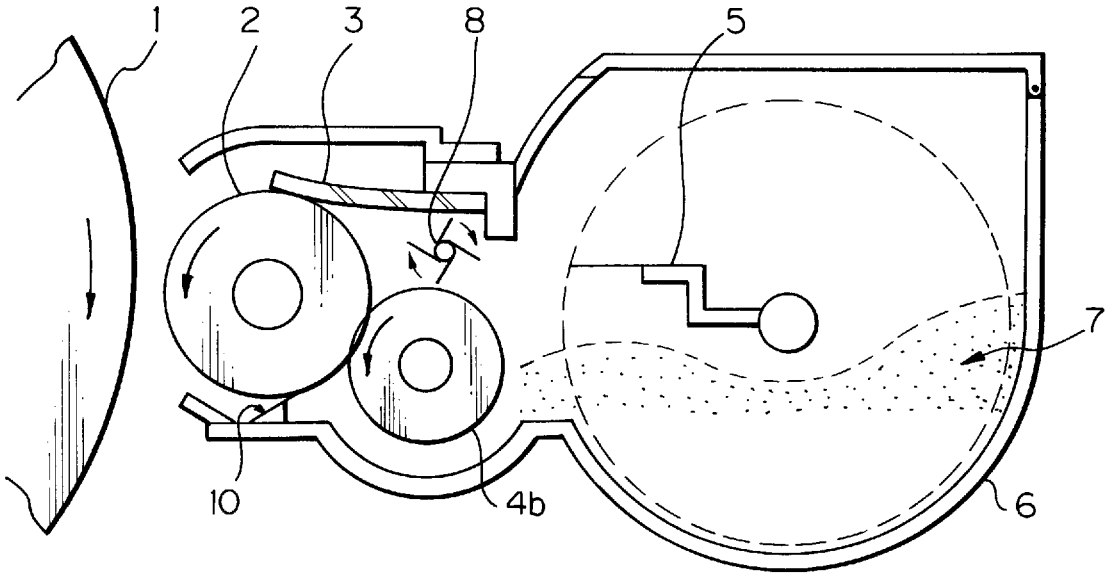
FIG. 10 is a section showing a second embodiment of the present invention.

A reference will be made to FIG. 10 for describing a second embodiment of the present invention. As shown, the upper feed roller 4*a* formed of foam polyurethane is replaced with an agitator 8 having four blades fitted on a shaft. The agitator 8 returns the toner 7 tending to get under the blade 3 to the hopper 6, and thereby prevents it from staying below the blade 3. This makes it needless for the blade 3 to be pressed against the developing roller 2 under high pressure. It is therefore possible to maintain the total thickness of the toner layers constant without resorting to a sophisticated mechanism.

The toner 7 constantly forms a well between the lower roller 4*b* and the agitator 8. Therefore, even when a solid image is continuously formed a number of times, the toner 7 is continuously fed from the well to the developing roller 2. This prevents the image density from decreasing due to short toner. In addition, because the toner 7 scarcely stays on the seal member 10, stable images are attainable with a simple seal member 10.

Of course, the agitator 8 may be replaced with a brush roller implemented by polyester fibers. The brush roller will be positioned at the shaft portion of the agitator 8.

3rd Embodiment

Figure 11:
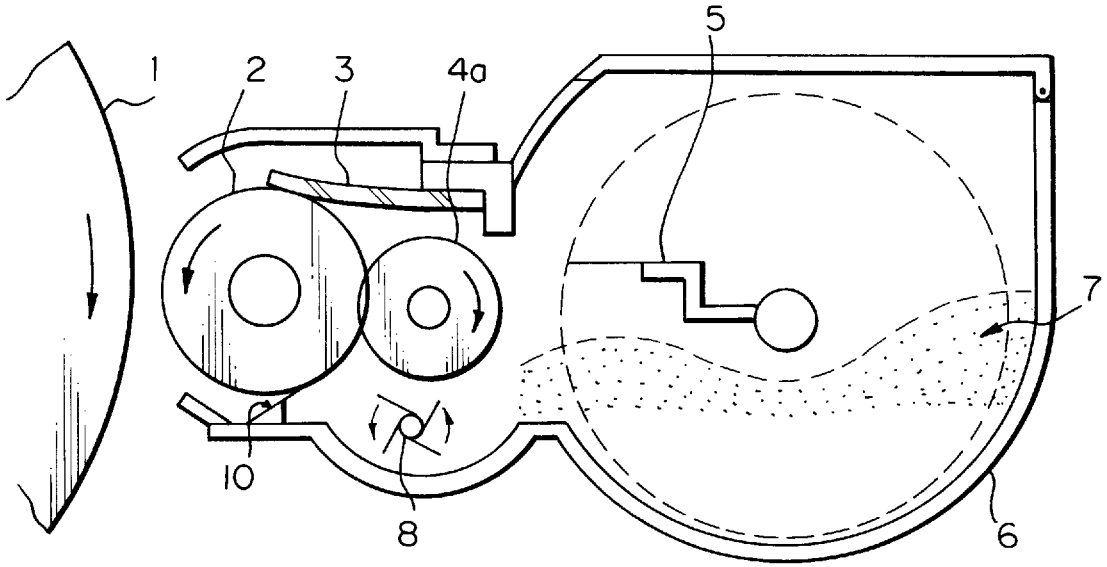
FIG. 11 is a section showing a third embodiment of the present invention.

FIG. 11 shows a third embodiment of the present invention. As shown, the lower feed roller 4*b* formed of foam polyurethane is replaced with the agitator 8 having four blades fitted on a shaft. The toner 7 constantly forms a well between the upper roller 4*a* and the agitator 8. Therefore, even when a solid image is continuously formed a number of times, the toner 7 is continuously fed from the well to the roller 2. This prevents the image density from decreasing due to short toner. In addition, because the toner 7 scarcely stays on the seal member 10, stable images are attainable with a simple seal member 10.

Again, the agitator 8 may be replaced with a brush roller implemented by polyester fibers. The brush roller will be positioned at the shaft portion of the agitator 8.

4th Embodiment

Figure 12:
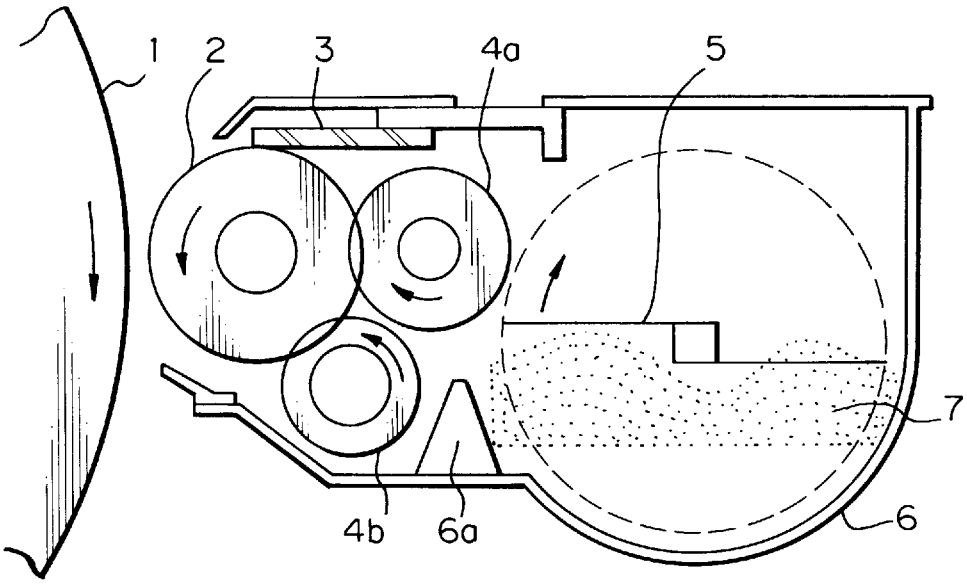
FIG. 12 is a section showing a fourth embodiment of the present invention.
Figure 13:
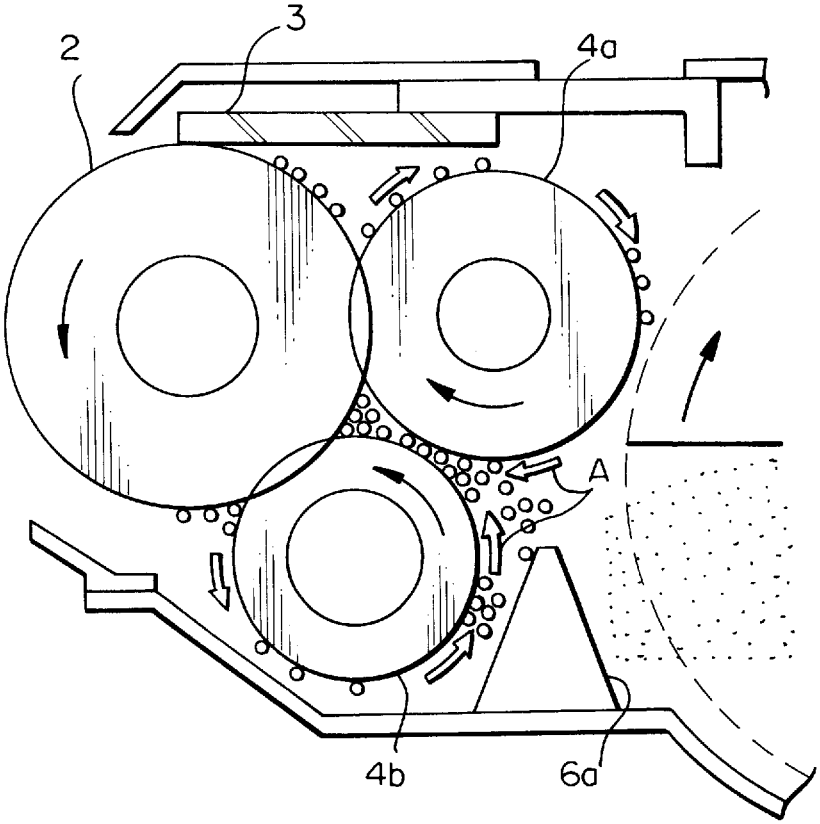
FIG. 13 shows the movement of toner to occur in the fourth embodiment.
Figure 14:
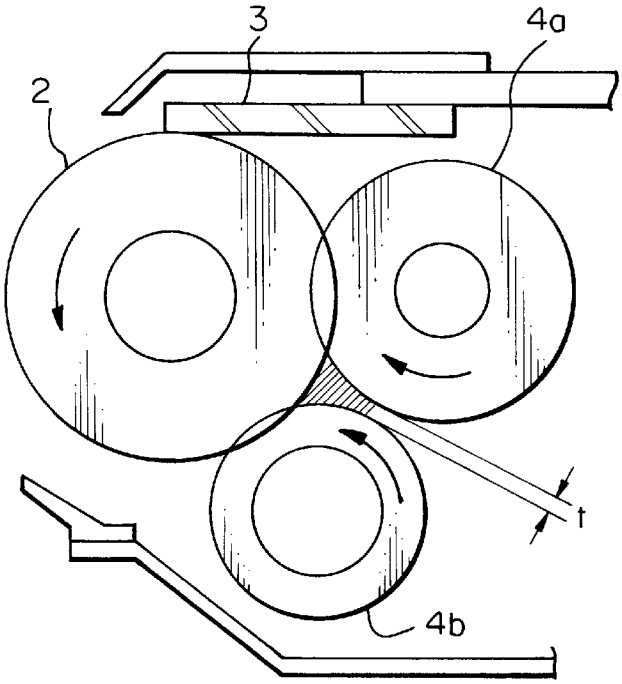
FIG. 14 shows a portion characterizing the fourth embodiment.

Referring to FIGS. 12–14, a fourth embodiment of the present invention will be described. As shown in FIG. 12, the upper and lower rollers 4*a* and 4*b* rotating in contact with the developing roller 2 feed the toner 7 delivered from the toner hopper 6 to the roller 2 via the gap between the rollers 4*a* and 4*b*. In FIG. 13, the movement of the toner 7 from the hopper 6 toward the roller 2 is indicated by an outline arrow A, and so is done the movement of the toner around the rollers 4*a* and 4*b*. The roller 4*b* located upstream of the roller 4*a* with respect to the formation of the toner layer conveys the fresh or noncharged toner 7 delivered from the hopper 6 to the roller 2. At the same time, the roller 4*b* scrapes off the toner remaining on the roller 2 at the nip between the rollers 4*b* and 2, and returns the toner below the roller 2 toward the hopper 6. The roller 4*a* downstream of the roller 4*b* conveys the toner existing between the rollers 4*a* and 4*b* by way of the nip between the rollers 4*a* and 2, charging the toner by friction and allowing the toner to deposition the roller 2 in a regulated amount. Further, the roller 4*a* returns noncharged toner gotten under the blade 3 to the hopper 6.

To cause each of the rollers 4*a* and 4*b* to exhibit the respective function, it is preferable that the minimum distance t (see FIG. 14) between the rollers 4*a* and 4*b* be 0.2 mm to 2 mm, for the following reason. If the minimum distance t is smaller than 0.2 mm, then the amount of toner to enter the space surrounded by the rollers 4*a*, 4*b* and 2 (indicated by hatching in FIG. 14) is limited. Therefore, when the toner is consumed only locally in the axial direction of the roller 2, the toner distribution in the axial direction of the roller 2 is apt to become irregular in the above space. On the other hand, if the minimum distance t is greater than 2 mm, then the toner once entered the above space tends to flow thereoutof. This prevents the toner to collect densely in the space. As a result, the pressure with which the toner tends to pass through the nip between the rollers 4*a* and 2 is too low to cause the toner to deposition the roller 2 stably.

When the minimum distance t is between 0.2 mm and 2 mm, as stated above, a sufficient toner density is stably maintained in the space indicated by hatching in FIG. 14. Therefore, the toner deposition on the roller 2 recovers immediately after the development of a solid image. In addition, the toner is smoothly recirculated, as indicated by the outline arrows in FIG. 13. This successfully simplifies the blade 3 or similar toner regulating mechanism and a seal mechanism disposed below the roller 2.

In this embodiment, a projection or partition 6*a* protrudes upward from the casing and separates the hopper 6 and the space around the lower roller 4*b*.

Figure 15:
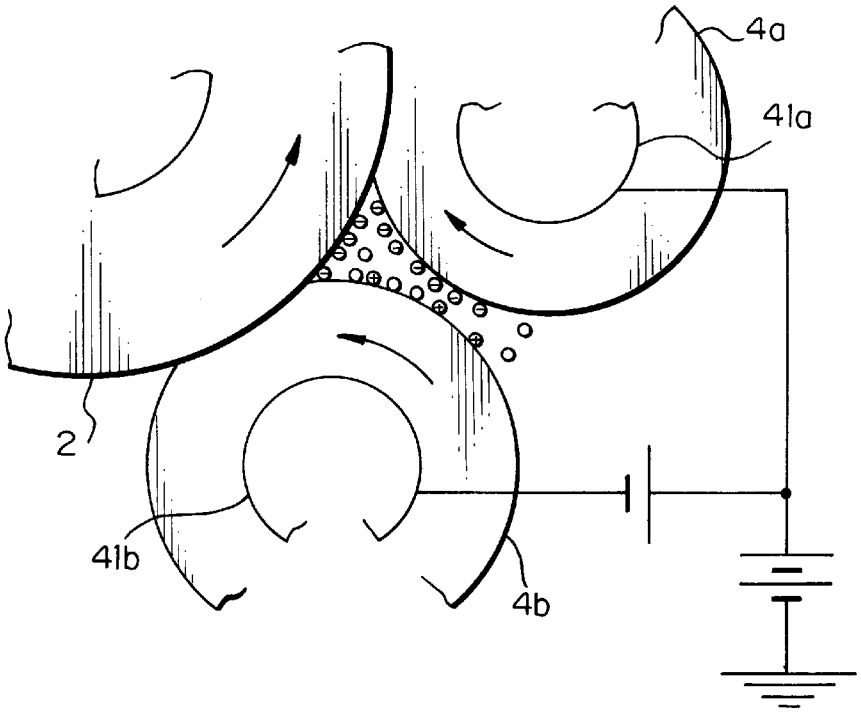
FIGS. 15–19, 20A and 20B show various improved forms of the fourth embodiment.

FIG. 15 shows an improved form of the above embodiment. As shown, at the time of development, a voltage source applies a particular potential to each of the two rollers 4*a* and 4*b* such that the toner migrates from the roller 4*b* toward the roller 4*a*. In this condition, in the region between the rollers 4*a* and 4*b*, only the toner of expected charge (negative charge in this case) migrates toward the upper roller 4*a*. In addition, the noncharged toner and the toner of opposite charge (positive charge in this case) migrate toward the lower roller 4*b*. This increases the chance that such undesirable toner is brought into contact with the rollers 4*b* and 2 and charged to the expected polarity thereby. Hence, even when the amount of charge deposited on the toner is small, e.g., in a humid environment, the undesirable toner is scarcely introduced into the toner layer with the result that a minimum of toner is allowed to fly out of the developing device. The toner deposition recovers immediately after the development of, e.g., a solid image, insuring constant image density.

Figure 16:
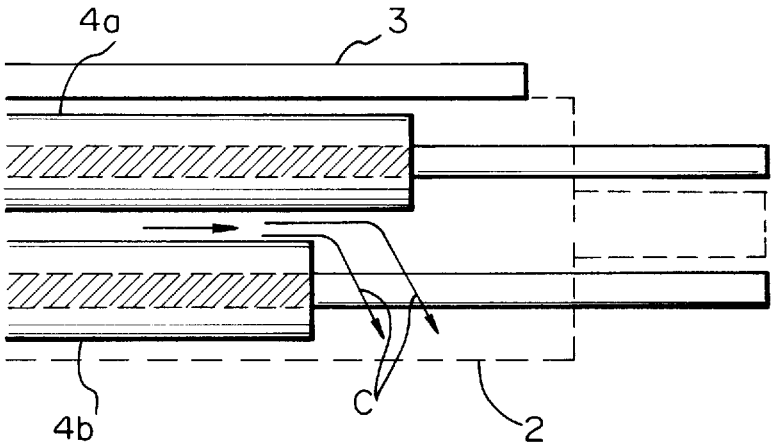
Figure 17:
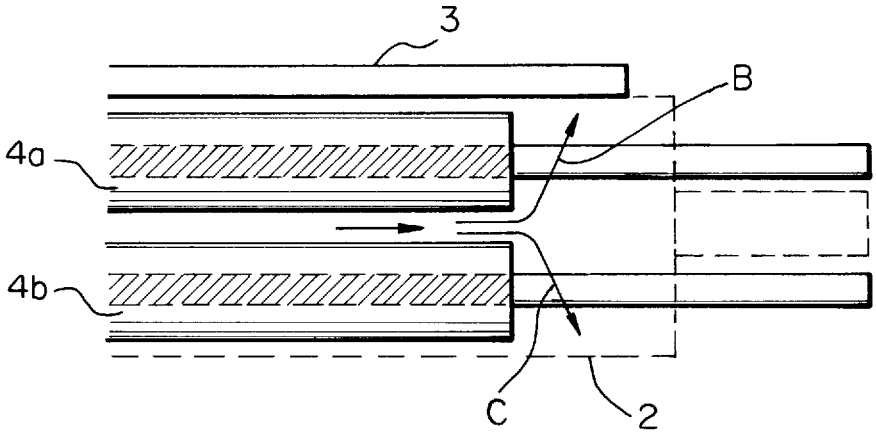
Figure 18:
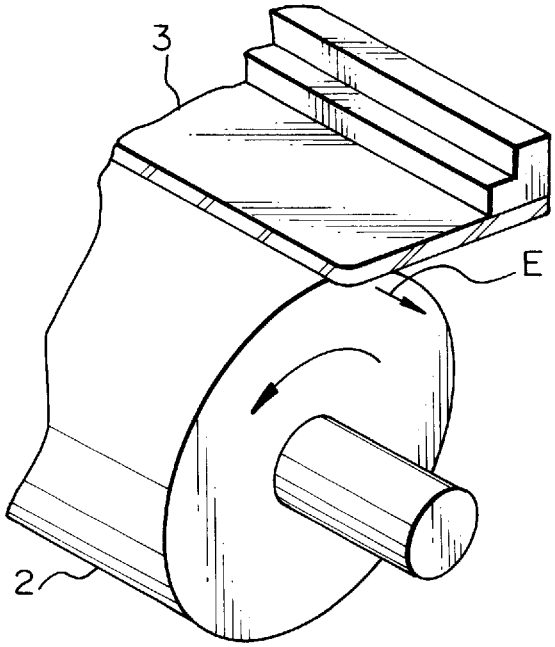

FIG. 16 shows another improved form of the illustrative embodiment. As shown, the two rollers 4*a* and 4*b* are dimensioned such that the downstream roller 4*a* contacts the roller 2 over a greater axial dimension than the upstream roller 4*b*, as indicated by hatching. Because the pressure of the toner is high in the region between the rollers 4*a* and 4*b*, the toner is apt to shootout via the opposite ends of the above region. Arrows C indicate the direction in which the toner advances. By contrast, assume that the rollers 4*a* and 4*b* have the same axial dimension, as shown in FIG. 17, or that the roller 4*b* is longer than the roller 4*a*. Then, at each end of the above region as shown by arrow B, a part of the toner shoots out toward the adjoining end of the blade 3 positioned above the roller 4*a*. Assume that such a part of the toner is continuously sent to the end where the blade 3 and roller 2 contact each other. Then, as indicated by an arrow E in FIG. 18, the toner leaks to the outside of the developing device and contaminates the interior of the copier. As shown in FIG. 16, when the roller 4*a* contacts the roller 2 over a greater axial dimension than the roller 4*b*, the toner shoots out downward and does not leak via the end of the blade 3. The toner shootout downward is successfully returned toward the hopper by the roller 4*b*. As a result, the toner is prevented from collecting at the opposite ends of the developing device.

Figure 19:
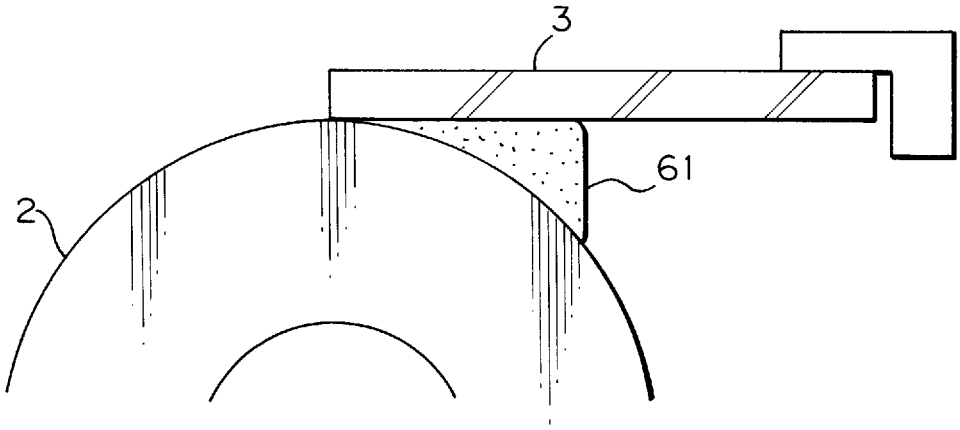

If desired, as shown in FIG. 19, seal members 61 may be positioned between the opposite ends of the blade 3 and the roller 2 in order to prevent the toner from leaking. The seal members 61 may be formed of sponge.

Figure 20A:
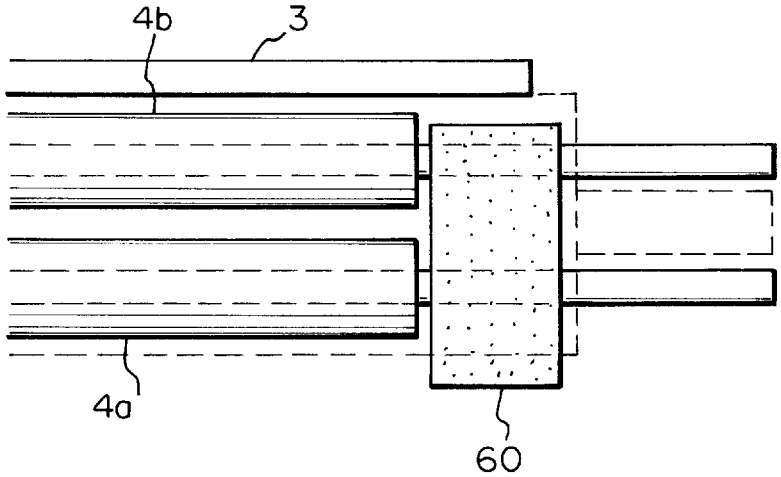
Figure 20B:
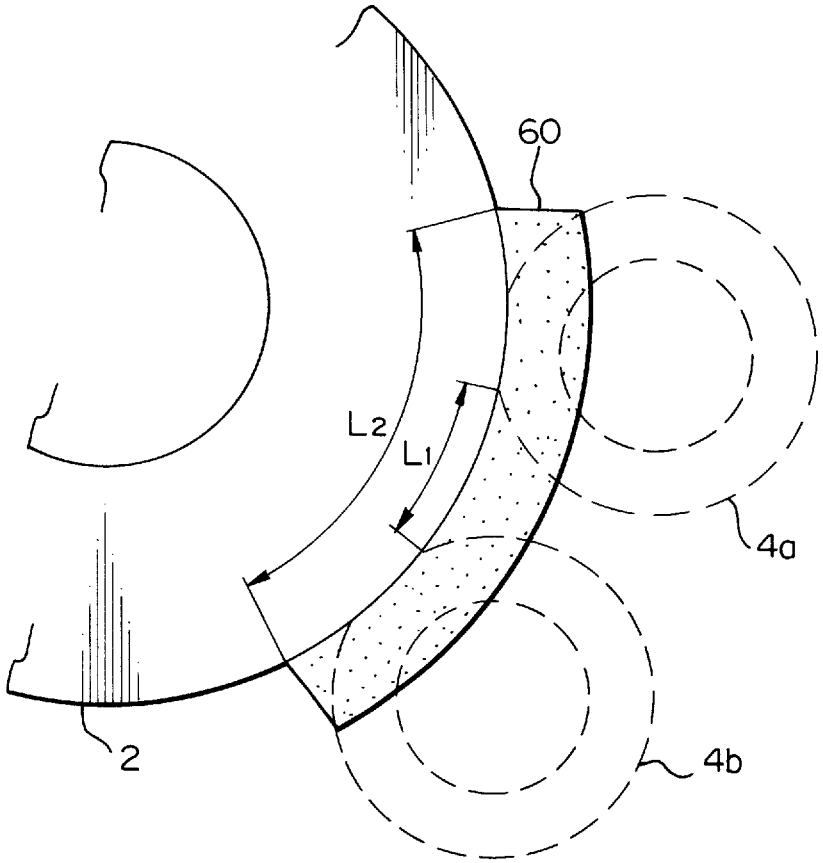

FIGS. 20A and 20B show another improved form of the illustrative embodiment. As shown, a seal member 60 contacts and presses the end of the roller 2. As shown in FIG. 20B, the seal member 60 has a length L2, as measured in the circumferential direction of the roller 2, which is greater than the length L1 of the region delimited by the rollers 4*a* and 4*b*. Specifically, the toner tends to flow out via the end of the region between the rollers 4*a* and 4*b* due to its high pressure, as stated with reference to FIGS. 16 and 17. As shown in FIG. 20A, the seal member 60 contacts the end of the roller 2 in order to obviate the above occurrence. As shown in FIG. 20B, the seal member 60 covers the region delimited by the rollers 4*a* and 4*b*.

Examples of the fourth embodiment will be described hereinafter.

[EXAMPLE 1]

The blade 3 was formed of urethane rubber and provided with a thickness of 2 mm and a length of 11 mm to its free end. The blade 3 bit 0.6 mm into the developing roller 2. The distance between the point of the blade 3 contacting the roller 2 and the free end was 0.5 mm.

The roller 2 had an aluminum core having a diameter of 20 mm. The surface of the roller 2 was knurled at a pitch of 0.3 mm to form 0.1 mm deep, 0.2 mm wide grooves in a crosshatch pattern. The grooves were inclined 45 degrees. The knurled surface of the core was coated with epoxy modified silicone resin (SR2115 available from Toray) so as to form a dielectric layer. The dielectric layer was dried at 50° C. for about 90 minutes. Finally, as shown in FIGS. 7A and 7B, the surface of the roller 2 was ground until the aluminum surface 51 and dielectric surface 52 appeared in a ratio of 3:7.

The upper roller 4*a* was formed of polyurethane sponge with carbon kneaded therein. The roller 4*a* had a diameter of 13 mm and a wall thickness of 3 mm. The roller 4*a* bit 0.5 mm into the roller 2 and moved at a linear velocity 0.5 times (opposite direction) that of the roller 2.

The lower roller 4*b* was also formed of polyurethane sponge with carbon kneaded therein. The roller 4*b* had a diameter of 13 mm and a wall thickness of 3 mm. The roller 4*a* bit 1 mm into the roller 2 and moved at a linear velocity 0.8 times (same direction) that of the roller 2.

The gap between the drum 1 and the roller 2 was 150 $\mu$m. DC −750 V was applied as a bias for development.

The drum 1 was implemented by an organic photoconductor (OPC). The surface potential deposited on the drum 1 was −850 V in the background area or −100 V in an image area.

For the toner 7, use was made of negatively chargeable toner formed of a mixture of nonmagnetic styrene-acryl resin and polyester resin. The toner 7 had a particle size of 10 μm. 0.7 wt % of fine powder of hydrophobic silica was added to the outer periphery of the toner 7.

In Example 1, the toner fed to the space defined by the rollers 4*a*, 4*b* and 2 maintained its powder pressure at all times. Therefore, a decrease in image density ascribable to short toner did not occur even when a solid image was continuously formed a number of times. Further, the toner did not stay below the blade 3, so that the blade 3 could maintain the thickness of the toner layer constant with a simple configuration. In addition, the toner below the roller 4*b* was automatically returned to the hopper. This eliminated the need for a seal member below the roller 2.

[EXAMPLE 2]

Example 1 was repeated except that a potential of −750 V and a potential of −950 V were respectively applied to the rollers 2 and 4*b* at the time of development. The roller 4*a* was held at the same potential as the roller 2. The linear velocity of the drum 1 and that of the roller 2 were increased to 330 mm/sec for image formation. In this condition, the toner flew as little as when the linear velocities of the drum 1 and roller 2 were 200 mm/sec toward a blade cover 6*b* and a chin portion 6*c* (see FIG. 14). Because the toner flies about little, a high-speed image forming device is achievable. The above advantages were also achieved when the rollers 4*b* and 4*a* were respectively applied with voltages of −850 V and −650 V while the roller 2 was applied with the same voltage of −750 V.

[EXAMPLE 3]

Example 1 was repeated except that the sponge portion of the roller 4*b* was about 2 mm shorter than that of the roller 4*a*. Such a configuration prevented the toner from shooting out downward via the end of the rollers 4*a* and 4*b*. The seal member or sponge 61 shown in FIG. 19 successfully prevented the toner from leaking to the outside of the developing device.

[EXAMPLE 4]

Example 1 was repeated except that the roller 2 was longer than the rollers 4*a* and 4*b*, and that seal members in the form of fur brushes were held in contact with opposite ends of the roller 2. The seal members were each longer than the region between the rollers 4*a* and 4*b*, as measured in the circumferential direction of the roller 2, as shown in FIG. 20B. In this condition, even when the toner shot out via the ends of the roller 2 due to its pressure, it was prevented from leaking to the outside of the developing deice. This allowed the device to be operated over a long period of time.

With any of Examples 1–4 described above, it is possible to insure attractive images by preventing the toner 7 from flying about and obviating background contamination.

Various modifications will become possible for those skilled in the art after receiving the teachings of the present disclosure without departing from the scope thereof.

What is claimed is:

1. A developing device for developing a latent image formed on an image carrier with a single-ingredient type developer with or without an auxiliary agent covering an outer periphery of said developer, said device comprising:

a casing;

a developer carrier for carrying the developer thereon by charging the developer to a preselected polarity, said developer carrier being rotatable such that a side of a periphery thereof received in said casing moves upward;

a developer regulating member for regulating the developer deposited on said developer carrier in a layer to a preselected thickness;

a first developer feeding member contacting said developer carrier at a side closer to a developer storing section than said developer carrier, and rotatable such that a surface portion of said first developer feeding member facing a bottom portion of said casing moved toward the developer storing section; and a second developer feeding member located downstream of said first developer feeding member, but upstream of said developer regulating member, in a direction of conveyance in which said developer carrier conveys the developer, and rotatable in or out of contact with said developer carrier in a direction opposite to a direction of rotation of said first developer feeding member;

wherein said first and second developer feeding members are spaced by a gap of 0.2 mm to 2 mm.

2. A developing device for developing a latent image formed on an image carrier with a single-ingredient type developer with or without an auxiliary agent covering an outer periphery of said developer, said device comprising:

a casing;

a developer carrier for carrying the developer thereon by charging the developer to a preselected polarity, said developer carrier being rotatable such that a side of a periphery thereof received in said casing moves upward;

a developer regulating member for regulating the developer deposited on said developer carrier in a layer to a preselected thickness;

a rotary developer feeding member located downstream of said developer carrier in a direction of conveyance in which said developer carrier conveys the developer, and rotatable in contact with said developer carrier in a same direction as said developer carrier, for feeding the developer to said developer carrier; and a developer conveying member positioned above said developer feeding member, and rotatable in a direction opposite to a direction of rotation of said developer carrier and said developer feeding member;

wherein said developer feeding member and said developer conveying member are spaced by a gap of 0.2 mm to 2 mm.

3. A device as claimed in claim 2, further comprising a seal member closing a gap between said developer carrier and a bottom portion of said casing to thereby prevent the developer from leaking through said gap between said developer carrier and said bottom portion of said casing.

4. A developing device for developing a latent image formed on an image carrier with a single-ingredient type developer with or without an auxiliary agent covering an outer periphery of said developer, said device comprising:

a casing;

a developer carrier for carrying the developer thereon by charging the developer to a preselected polarity, said developer carrier being rotatable such that a side of a periphery thereof received in said casing moves upward;

a developer regulating member for regulating the developer deposited on said developer carrier in a layer to a preselected thickness;

a rotary developer feeding member located downstream of said developer carrier in a direction of conveyance in which said developer carrier conveys the developer, and rotatable in contact with said developer carrier in a direction opposite to a direction of rotation of said developer carrier, for feeding the developer to said developer carrier; and a developer conveying member positioned below said developer feeding member, and rotatable in a same direction as said developer carrier;

wherein said developer feeding member and said developer conveying member are spaced by a gap of 0.2 mm to 2 mm.

5. A device as claimed in claim 4, further comprising a seal member closing a gap between said developer carrier and a bottom portion of said casing to thereby prevent the developer from leaking through said gap between said developer carrier and said bottom portion of said casing.

6. A developing device for developing a latent image formed on an image carrier with a single-ingredient type developer with or without an auxiliary agent covering an outer periphery of said developer, said device comprising:

a casing;

a developer carrier for carrying the developer thereon by charging the developer to a preselected polarity, said developer carrier being rotatable such that a side of a periphery thereof received in said casing moves upward;

a developer regulating member for regulating the developer deposited on said developer carrier in a layer to a preselected thickness;

a first developer feeding member contacting said developer carrier at a side closer to a developer storing section than said developer carrier, and rotatable such that a surface portion of said first developer feeding member facing a bottom portion of said casing moves toward said developer storing section; and a second developer feeding member located downstream of said first developer feeding member, but upstream of said developer regulating member, in a direction of conveyance in which said developer carrier conveys the developer, and rotatable in contact with said developer carrier in a direction opposite to a direction of rotation of said first developer feeding member;

wherein said first and second developer feeding members are formed of foam resin such that said first developer feeding member has a higher foam density than said second developer feeding member.

7. A device as claimed in claim 6, further comprising a seal member closing a gap between said developer carrier and a bottom portion of said casing to thereby prevent the developer from leaking through said gap.

8. A developing device for developing a latent image formed on an image carrier with a single-ingredient type developer with or without an auxiliary agent covering an outer periphery of said developer, said device comprising:

a casing;

a developer carrier for carrying the developer thereon by charging the developer to a preselected polarity, said developer carrier being rotatable such that a side of a periphery thereof received in said casing moves upward;

a developer regulating member for regulating the developer deposited on said developer carrier in a layer to a preselected thickness;

a first developer feeding member contacting said developer carrier at a side closer to a developer storing section than said developer carrier, and rotatable such that a surface portion of said first developer feeding member facing a bottom portion of said casing moves toward said developer storing section; and a second developer feeding member located downstream of said first developer feeding member, but upstream of said developer regulating member, in a direction of conveyance in which said developer carrier conveys the developer, and rotatable in contact with said developer carrier in a direction opposite to a direction of rotation of said first developer feeding member;

wherein said first and second developer feeding members are positioned such that said second developer feeding member bites into said developer carrier more than said first developer feeding member.

9. A device as claimed in claim 8, further comprising a seal member closing a gap between said developer carrier and a bottom portion of said casing to thereby prevent the developer from leaking through said gap.

10. A developing device for developing a latent image formed on an image carrier with a single-ingredient type developer with or without an auxiliary agent covering an outer periphery of said developer, said device comprising:

a casing;

a developer carrier for carrying the developer thereon by charging the developer to a preselected polarity, said developer carrier being rotatable such that a side of a periphery thereof received in said casing moves upward;

a developer regulating member for regulating the developer deposited on said developer carrier in a layer to a preselected thickness;

a first developer feeding member contacting said developer carrier at a side closer to a developer storing section than said developer carrier, and rotatable such that a surface portion of said first developer feeding member facing a bottom portion of said casing moves toward said developer storing section; and a second developer feeding member located downstream of said first developer feeding member, but upstream of said developer regulating member, in a direction of conveyance in which said developer carrier conveys the developer, and rotatable in contact with said developer carrier in a direction opposite to a direction of rotation of said first developer feeding member;

wherein said first and second developer feeding members are formed of foam resin such that said second developer feeding member has a greater wall thickness than said first developer feeding member.

11. A device as claimed in claim 10, further comprising a seal member closing a gap between said developer carrier and a bottom portion of said casing to thereby prevent the developer from leaking through said gap.

12. A developing device for developing a latent image formed on an image carrier with a single-ingredient type developer with or without an auxiliary agent covering an outer periphery of said developer, said device comprising:

a casing;

a developer carrier for carrying the developer thereon by charging the developer to a preselected polarity, said developer carrier being rotatable such that a side of a periphery thereof received in said casing moves upward;

a developer regulating member for regulating the developer deposited on said developer carrier in a layer to a preselected thickness;

a first developer feeding member contacting said developer carrier at a side closer to a developer storing section than said developer carrier, and rotatable such that a surface portion of said first developer feeding member facing a bottom portion of said casing moves toward the developer storing section; and a second developer feeding member located downstream of said first developer feeding member, but upstream of said developer regulating member, in a direction of conveyance in which said developer carrier conveys the developer, and rotatable in contact with said developer carrier in a direction opposite to a direction of rotation of said first developer feeding member;

wherein a shaft on which said first developer feeding member is mounted has a greater diameter than a shaft on which said second developer feeding member is mounted.

13. A device as claimed in claim 12, further comprising a seal member closing a gap between said developer carrier and a bottom portion of said casing to thereby prevent the developer from leaking through said gap.

14. A developing device for developing a latent image formed on an image carrier with a single-ingredient type developer with or without an auxiliary agent covering an outer periphery of said developer, said device comprising:

a casing;

a developer carrier for carrying the developer thereon by charging the developer to a preselected polarity, said developer carrier being rotatable such that a side of a periphery thereof received in said casing moves upward;

a developer regulating member for regulating the developer deposited on said developer carrier in a layer to a preselected thickness;

a first developer feeding member contacting said developer carrier at a side closer to a developer storing section than said developer carrier, and rotatable such that a surface portion of said first developer feeding member facing a bottom portion of said casing moves toward the developer storing section; and a second developer feeding member located downstream of said first developer feeding member, but upstream of said developer regulating member, in a direction of conveyance in which said developer carrier conveys the developer, and rotatable in contact with said developer carrier in a direction opposite to a direction of rotation of said first developer feeding member;

wherein a ratio of a velocity of said first developer feeding member to a velocity of said developer carrier is only sufficient for said first developer feeding member to scrape off the developer remaining on said developer carrier and convey the developer into said casing, and is less than 1 inclusive, and wherein a ratio of a velocity of said second developer feeding member to the velocity of said image carrier is only sufficient for said second developer feeding member to feed a sufficient amount of the developer chargeable to said developer carrier.

15. A device as claimed in claim 14, further comprising a seal member closing a gap between said developer carrier and a bottom portion of said casing to thereby prevent the developer from leaking through said gap.

16. A developing device for developing a latent image formed on an image carrier with a single-ingredient type developer with or without an auxiliary agent covering an outer periphery of said developer, said device comprising:

a developer carrier for charging the developer to a preselected polarity, and conveying the developer to a developing position;

a developer regulating member for regulating the developer being conveyed by said developer carrier in a form of a layer to the developing position to a preselected thickness; and a first and a second developer feeding members contacting or adjoining said developer carrier at a developer storing section side, and rotatable to move the developer from the developer storing section side toward said developer carrier via a region where said first and second developer feeding members face each other;

wherein a distance at which said first and second developer feeding members are closest to each other in said region is above a preselected lower limit, but below a preselected upper limit;

said lower limit being a minimum distance allowing, even when the developer is locally consumed by development in a lengthwise direction of said developer carrier, the developer to be fed to a space surrounded by said first and second developer feeding members and said developer carrier in an amount capable of reducing localization of the developer in said region to a degree which prevents the developer from being fed to said developer carrier unevenly in the lengthwise direction of said developer carrier; and said upper limit being a maximum distance generating a restricting force, against a return of the developer from said region to said developer storing section, guaranteeing a developer pressure in said space to a degree which prevents an amount of the developer passing through a position where a downstream one of said first and second developer feeding members in a direction of developer conveyance by said developer carrier and said developer carrier contactor adjoin from becoming unstable.

17. A device as claimed in claim 16, wherein said first and second developer feeding members are spaced by a gap of 0.2 mm to 2 mm.

18. A developing device for developing a latent image formed on an image carrier with a single-ingredient type developer with or without an auxiliary agent covering an outer periphery of said developer, said device comprising:

a developer carrier for charging the developer to a preselected polarity, and conveying the developer to a developing position;

a developer regulating member for regulating the developer being conveyed by said developer carrier in a form of a layer to the developing position to a preselected thickness; and a first and a second developer feeding members contacting or adjoining said developer carrier at a developer storing section side, and rotatable to move the developer from the developer storing section side toward said developer carrier via a region where said first and second developer feeding members face each other;

wherein said first and second developer feeding members have lengths thereof selected such that a downstream one of said first and second developer feeding members in a direction of developer conveyance by said developer carrier contacts or adjoins said developer carrier over a greater width than an upstream one of said first and second developer feeding members.

19. A developing device for developing a latent image formed on an image carrier with a single-ingredient type developer with or without an auxiliary agent covering an outer periphery of said developer, said device comprising:

a developer carrier for charging the developer to a preselected polarity, and conveying the developer to a developing position;

a developer regulating member for regulating the developer being conveyed by said developer carrier in a form of a layer to the developing position to a preselected thickness;

a first and a second developer feeding members contacting or adjoining said developer carrier at a developer storing section side, and rotatable to move the developer from the developer storing section side toward said developer carrier via a region where said first and second developer feeding members face each other, said first and second developer feeding members being smaller in width than said developer carrier; and a member located outward of said first and second developer feeding members with respect to a widthwise direction of said developer carrier, for restricting outward movement of the developer on said developer carrier in said widthwise direction, said member covering a portion over which said first and second developer feeding members contactor adjoin said developer carrier.

* * * * *